United States Patent [19]

Laskowitz

[11] Patent Number: 4,715,654

[45] Date of Patent: Dec. 29, 1987

[54] RECLINING CHAIR WITH RETRACTABLE FOOTREST

[76] Inventor: Joseph F. Laskowitz, 1552 Estrada, Apt. 5, St. Louis, Mo. 63138

[21] Appl. No.: 24,921

[22] Filed: Mar. 17, 1987

Related U.S. Application Data

[63] Continuation of Ser. No. 837,491, Mar. 7, 1986, abandoned.

[51] Int. Cl.[4] ..... A47C 1/02

[52] U.S. Cl. ..... 297/329; 297/330; 297/429; 248/430

[58] Field of Search ..... 297/329, 330, 429–432; 248/430, 398

[56] References Cited

U.S. PATENT DOCUMENTS

| | | | |
|---|---|---|---|
| 240,050 | 4/1881 | Starr | 297/429 |
| 805,805 | 11/1905 | Loose | 297/408 X |
| 1,048,306 | 12/1912 | Greilick | 297/329 |
| 2,151,729 | 3/1939 | Baker | 297/430 X |
| 2,169,550 | 8/1939 | Arends | 297/430 X |
| 2,834,032 | 5/1958 | Scott | 297/377 |
| 3,232,575 | 2/1966 | Ferro | 297/329 X |
| 4,479,626 | 10/1984 | Kluting et al. | 297/329 X |

FOREIGN PATENT DOCUMENTS

| | | | |
|---|---|---|---|
| 1037093 | 8/1958 | Fed. Rep. of Germany | 297/329 |

*Primary Examiner*—Francis K. Zugel

*Attorney, Agent, or Firm*—Cohn, Powell & Hind

[57] ABSTRACT

This chair (10) includes a base portion (12), a seating portion (14) mounted for arcuate movement on said base portion (12), and an adjustable footrest assembly (40). The footrest assembly (40) includes opposed guide members (46) and a footrest (52) having opposed arms (54) which are received by the guide members (46) in sliding relation and are adjustably movable between an extended, elevated position to a retracted stored position. A drive assembly (62) is provided which includes spaced shafts (64, 66) carrying endless conveyor members (70) which are connected to the arms (54). The guide members (46) and the received arms (54) are arcuately configurated. A control system (100) including a longitudinal belt (102) attached to the upper seating portion (14) and received by a clamping assembly (106) attached to the base portion (12) provides for selective arresting of the seating portion (14) relative to the base portion (12) in a desired position.

12 Claims, 6 Drawing Figures

RECLINING CHAIR WITH RETRACTABLE FOOTREST

This application is a continuation of application Ser. No. 837,491, filed Mar. 7, 1986 now abandoned.

BACKGROUND OF THE INVENTION

This invention relates generally to lounge chairs and particularly to a retractable footrest assembly for a lounge chair.

There are many types of lounge chairs and probably most common are those generally known as recliners having tilting back portions. In such recliners, when the back is tilted rearwardly a footrest assembly moves outwardly and upwardly so that the user can assume a reclining position with virtually the full length of the body supported. The footrest assembly is generally carried by a somewhat complicated linkage assembly stored beneath the seat. In some cases a sliding assembly is provided, as exemplified by U.S. Pat. No. 2,458,185, in which the footrest member must be pulled out from underneath the seat somewhat in the manner of a drawer.

Another type of lounge chair is that known commercially as a Contour chair and is exemplified by the chair illustrated in U.S. Pat. No. Des. 157,269. This chair, designed by the present applicant, includes a fixed base having an arcuate track and a seating portion which is movably mounted on said track by means of rollers. While this chair provides an excellent reclining feature it has a disadvantage in that it is quite long and, since it does not have retractable parts, requires a relatively large amount of room space.

The present chair solves the above problems in a manner not disclosed in the known prior art.

SUMMARY OF THE INVENTION

This chair, which is an improvement on the Contour chair, includes a foreshortened upper seating portion mounted to a lower base portion in movable relation and provides a retractable footrest assembly for effectively extending the length of the seating portion.

The chair includes a lower base portion having opposed sides, an upper seating portion having opposed sides the seating portion being mounted to the base portion for longitudinal arcuate movement of said seating portion relative to said base portion. A retractable footrest assembly is provided which includes opposed guide means operatively carried by the seating portion sides, a movable footrest including opposed arms received by said guide means and a transverse footrest member mounted between said arms and drive means for moving said arms in fore and aft relation in said guide means.

It is an aspect of this invention to provide guide means which are arcuate tubular member and which receive compatibly arcuate footrest arms in sliding relation to determine the extension and elevation of the footrest member.

It is another aspect of this invention to provide that the transverse footrest member is pivotally mounted to rotate from an operative position to a generally vertical storage closure position.

It is an aspect of this invention to provide a drive means which includes a pair of longitudinally spaced transverse shafts each having at least one rotatable element mounted thereon, an endless flexible element extending between said spaced rotatable elements, connection means between the flexible elements and the elongate arms and to provide means for moving the flexible element and the connected arms to provide the fore and aft movement of the footrest relative to the seating portion. It is yet another aspect of this invention to provide a manually operated drive means.

Still another aspect of this invention is to provide control means between the seating portion and the base portion for selectively arresting arcuate movement of the seating portion on the base portion so that the seating portion can be maintained in a desired position.

In another aspect of this invention the control means includes a longitudinally extending flexible element attached at spaced points to one of the base end seating portions and to provide a selectively actuated clamping means attached to the other of said portions and receiving the flexible element in selectively releasably relation.

It is still another aspect of this invention to provide a transverse traveller shaft connected to adaptor means on a pair of endless conveyor elements the ends of the traveller member being received within longitudinal slots provided in the guide tubes to facilitate movement of the footrest assembly.

It is an aspect of this invention to provide a drive means which is carried in a mounting frame disposed between the side portions of the upper seating portion the mounting frame including arcuately formed longitudinal members for attachment of the arcuate guide tubes.

It is an aspect of this invention to provide a chair having a retractable footrest assembly which can be manually or electrically operated and is relatively inexpensive to manufacture and which is simple to use.

DESCRIPTION OF THE PREFERRED EMBODIMENT

Figure 1:
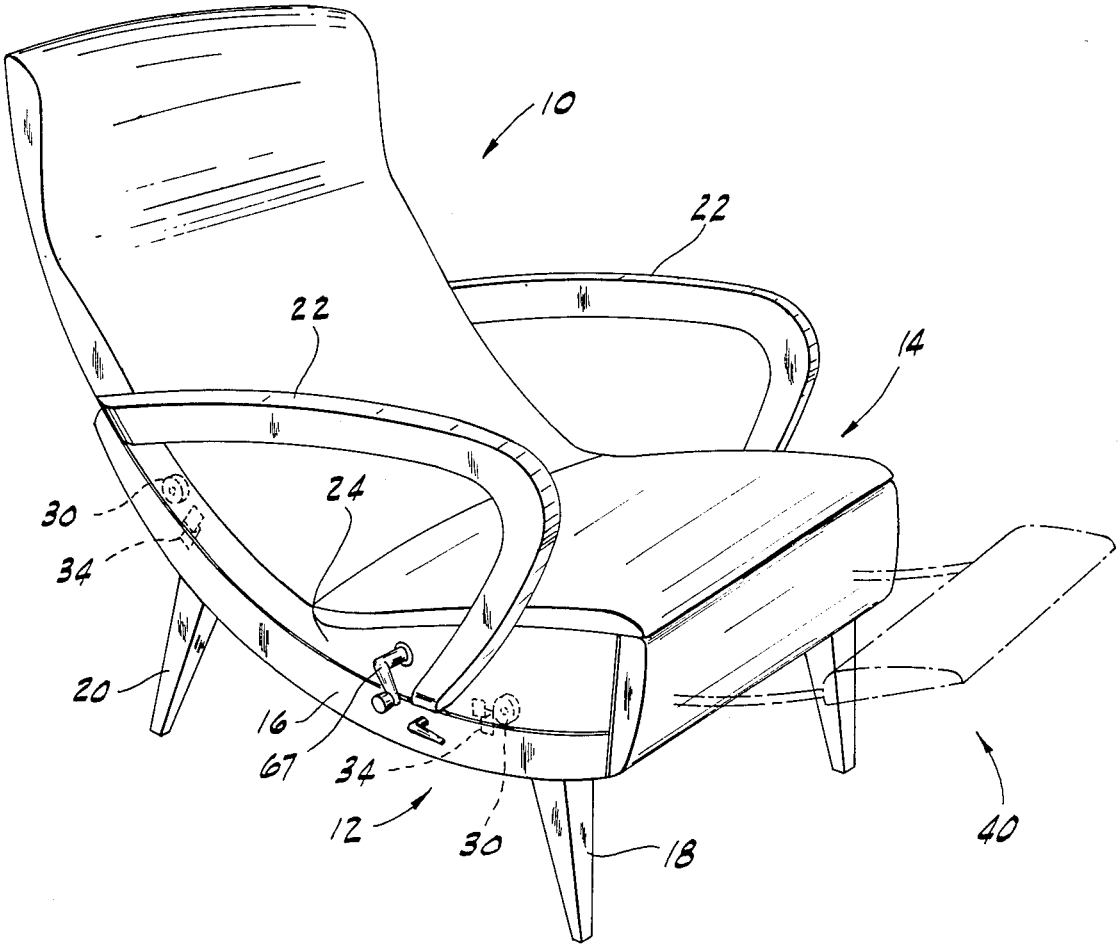
FIG. 1 is a perspective view of the chair illustrating the footrest assembly in the retracted and extended positions.

Referring now by reference numerals to the drawings and first to FIG. 1 it will be understood that the chair indicated by numeral 10 includes a lower base portion 12 and an upper seating portion 14. The base portion 12 includes opposed, generally arcuate side framing portions 16 each carried by fore and aft legs 18 and 20 and each having a fixed armrest 22. The seating portion 14 also includes opposed, generally arcuate side framing portions 24 and is mounted to the base portion 12 for rolling movement relative to the base portion. It will be understood that the seating portion is considerably shorter than the conventional chair with a rolling seating portion depicted in U.S. Pat. No. Des. 157,269.

Figure 5:
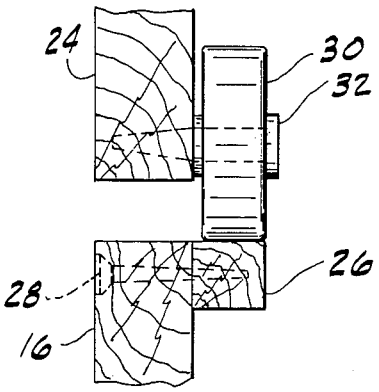
FIG. 5 is an enlarged sectional detail illustrating the chair roller assembly.
Figure 6:
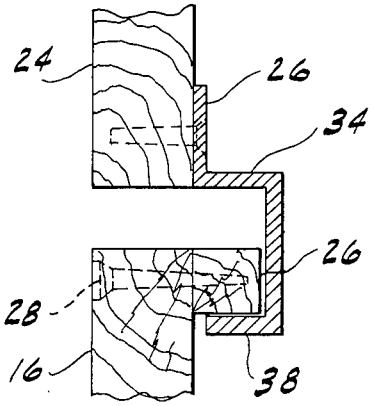
FIG. 6 is an enlarged sectional detail illustrating the holding assembly between the seating portion and the base portion.

In the preferred embodiment, as shown in FIG. 5, the base side portions 16 are provided with a rail member 26 attached as by fasteners 28. The seating side portions 24 are provided with roller members 30 attached as by fasteners 32, which ride on the arcuate rail surface so that the seating portion 14 moves smoothly on the base portion 12. As shown in FIG. 6, the seating portion 14 is held in captive relation relative to the base portion 12 by means of retaining members 34 attached to the seating portion as by fasteners 36 and including a lower flange 38 engageable with the rail member 26. The rearward limit of the upper portion 14 relative to the base portion 12 is defined by interengageable stop members 29 and 31 provided on said upper and lower portions respectively as shown in FIG. 3.

As shown in FIG. 1 the chair 10 includes a retractable footrest assembly 40 which will now be described with particular reference to FIGS. 2, 3 and 4.

The footrest assembly 40 includes a mounting frame 42 having opposed longitudinal members 44 and front and rear transverse members 43 and 45, respectively, which, in the preferred embodiment are fixedly attached to the seating side portions 24 as by fasteners (not shown). The longitudinal members 44 are arcuately formed and provide a mounting surface for compatibly configurated tubular members 46, which are fixedly attached thereto in underslung relation, as by front and rear clip members 48 and 50 attached to the frame as by fasteners 49 and 51 respectively. The footrest assembly 40 also includes a manually adjustable movable footrest 52 having opposed longitudinally extending arcuate arms 54 operatively connected by an elongate member 56 extending transversely therebetween. The transverse member 56 carries a footrest pad 58 and member 56 is pivotally mounted thereto, between said arms 54, by means of clips 59 attached to the underside of said member 56, stub shafts 61 being provided between clips 59 and arms 54. The footrest pad 58 is biased in a counterclockwise direction as by a spring elements 60 disposed on said shafts 61.

Figure 3:
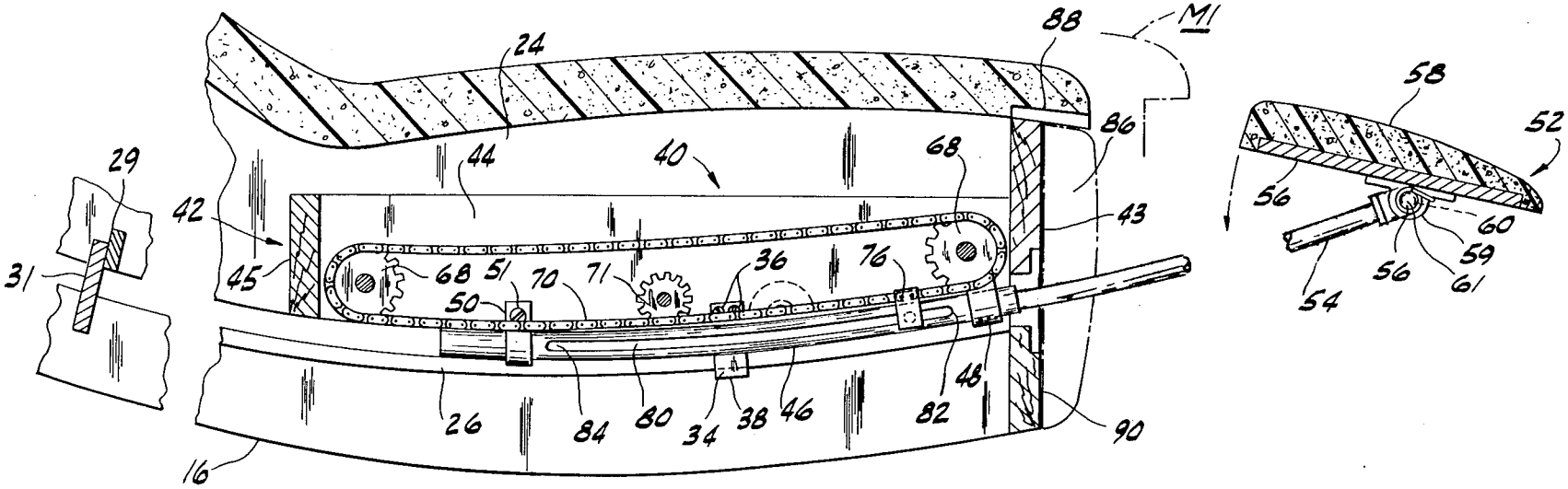
FIG. 3 is an enlarged sectional elevational view taken on line 3—3 of FIG. 2.
Figure 4:
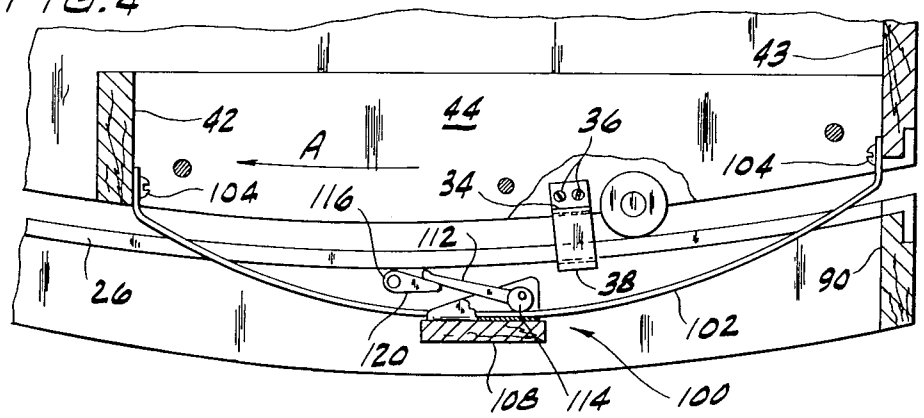
FIG. 4 is an enlarged sectional elevational view taken on line 4—4 of FIG. 2.

As best shown in FIG. 3, the arcuate arms 54 are received in sliding relation within the tubular members 46, which provide guide means defining the arcuate movement of the padded footrest 58 and determine the elevation of said footrest as it moves outwardly from said tubular members 46.

The footrest assembly 40 including an endless conveyor system 62, which provides a drive means for moving the footrest 52, and which is mounted within the mounting frame 42. In the preferred embodiment, the conveyor system 62 includes front and rear shafts 64 and 66, respectively, mounted in journal relation to longitudinal side members 44, each carrying a pair of rotatable elements, such as sprockets 68, which are connected in drive relation by an endless element, such as chain 70. The rear shaft 66 is extended outwardly and is provided, in the embodiment shown, with a manually rotatable crank 67. However, it will be understood that the shaft can be rotated electro-mechanically, if desired, as by an electric motor 130 drive sprocket 132 mounted to shaft 66 as shown in FIG. 2 and chain 134. Small electric motors are available that will fit in the confined space between side portion 16 and longitudinal frame member 44. As best shown in FIG. 2, the chains 70 are interconnected to a transverse traveller shaft member 72 by U-shaped adaptor members 74 attached to each chain, as by substitute chain link pins 76. The traveller member 72 is connected at its ends to each of the footrest arms 54, as by being received within openings 78 provided in said arms for the purpose. It will be understood from FIG. 3 that the elongate tubular members 46 are provided with longitudinal slots 80 on the inside thereof to receive the ends of the traveller member 72, and that the fore and aft ends of the slots 82 and 84 provide stops determining the length of travel of the footrest pad 58. As will be readily understood, the manually rotated rear shaft 66 induces longitudinal movement into the traveller member 72, and because of the connection of said traveller to said arms 54, into the footrest 52.

In the fully retracted position the member 56 and footrest pad 58 are received within the cavity 86 defined in part in the embodiment shown, by a front cross member 88 extending between the sides of the seating portion 44, the front transverse member 43 of the mounting frame 42 and a front cross member 90 extending between the sides of the base portion 12. The cross member 90 is aligned with and vertically spaced from member 43 to permit the arm 54 to extend therethrough. When the footrest pad 58 is in its closed, stored position and the chair 10 is in the rearward position shown in FIG. 1, the cavity 80 is filled by the footrest pad 58, member 56 engaging the surface presented by members 43 and 90, and forms the front of the chair. It will be understood that the seating portion 14, because of its rolling movement capability, can move forwardly of the position shown in FIG. 3, relative to the base prtion 12. This movement is indicated by the phantom outline indicated by M1 in FIG. 3.

In the preferred embodiment shown, the arcuate movement of the seating portion 14, relative to the base portion 12, is controlled by the operator by virtue of a control means which permits the position of the movable seating portion 14, relative to the stationary base portion 12, to be readily determined.

Figure 2:
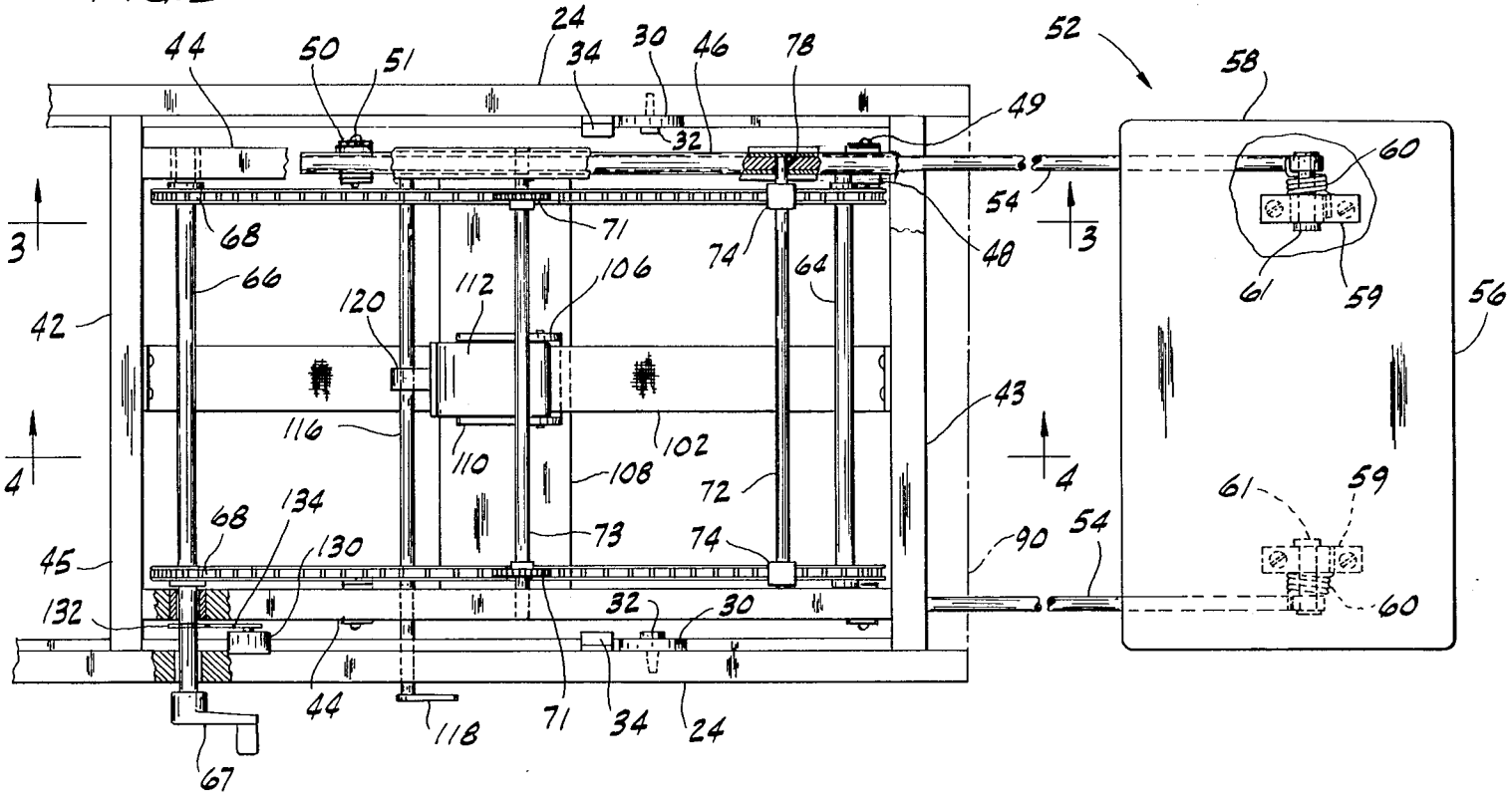
FIG. 2 is an enlarged plan view of footrest assembly.

As shown in FIGS. 2 and 3 the control means 100 in the preferred embodiment consists essentially of a flexible member such as a belt 102, which is fixedly attached at its ends as by fasteners 104, to the front and rear transverse members 43 and 45 respectively. A clamping assembly 106 is mounted to a transverse member 108 extending between and attached in fixed relation to the base side portions 16. The clamping assembly 106 is similar to that used for airplane seat belts and includes a U-shaped base 110 fixedly attached, as by fasteners (not shown) to transverse member 108 and having a spring-loaded rotatably mounted camming lever 112. The lever is provided with an offset cylindrical wedging cam 114 which tightens against the fabric belt 102 when the lever is moved counterclockwise about its axis of rotation. Accordingly, the seating portion 14 and the belt 102 can readily be moved between the cam and the base in the direction of the arrow A shown in FIG. 3 but cannot be moved in the opposite direction without release of the cam pressure. The release of the cam pressure is achieved by clockwise motion of the camming lever 112 and, in the preferred embodiment shown, this release is manually achieved by means of a control shaft 116 journal mounted between the base side portion 12 and having a crank handle 118 provided with a lever-engageable lug 120. As will be readily understood, counterclockwise rotation of the control shaft handle 120 induces clockwise rotation of the wedging cam 114 and releases the pressure of said cam to permit the belt 102 to move forwardly through the clamp base 110. When this occurs the upper seating portion 14 can move forwardly relative to the lower base portion 12 to a desired position. It will be understood that the clamping assembly 106 permits rolling movement of the seating portion within the pre-determined limits defined by the length of the belt 102.

The effective length of the seating portion 14 can be extended as desired by the operator. This is achieved simply by rotating the crank handle 67 in a clockwise direction so that the chain-carried traveller member 72 connected to the arms 54 moves said arms 54 outwardly of the tubular guide members 46. When the footrest pad 58 is free of the cavity it rotates counterclockwise through 90° under spring action or gravity to engage arms 54, see FIG. 3. The footrest pad 58 is returned to its storage position by reversing the direction of the crank 67 and manually rotating said footrest pad clockwise as by applying pressure to the forward edge of said pad by the heel of the foot of the operator.

Having described the invention in detail, those skilled in the art will appreciate that modifications may be made without departing from its spirit. Therefore, it is not intended that the scope of the invention be limited to the specific embodiments illustrated and described. Rather, it is intended that the scope of this invention be determined by the appended claims and their equivalents.

I claim as my invention:

1. A chair comprising:

(a) a lower base portion including opposed sides, (b) an upper seating portion including opposed sides, said seating portion being mounted to said base portion for longitudinal arcuate movement of said seating portion relative to said base portion, (c) retractable footrest assembly including:

1. guide means operatively carried between said seating portion sides including opposed elongate substantially tubular arcuately formed guide members,
2. a movable footrest including arm means including opposed arcuately formed arm members each received within one of the tubular members of said guide members and a transverse footrest member mounted between said arm members,
3. drive means for moving said arm members in said guide members, said drive means including a pair of longitudinally spaced transverse shafts each having at least one sprocket mounted thereon, an endless chain extending between said sprockets, connection means including a transverse traveller member attached at each end to said arm members and an adaptor member connecting said transverse member to said chain in direct drive relation, and means for moving said chain and said connected traveller member whereby said footrest moves fore and aft relative to said seating portion, and
4. said arcuate arm members extending outwardly of said arcuate guide members along the same generally arcuate line.

2. A chair as defined in claim 1, in which:

(d) control means are provided between said seating portion and said base portion for selectively arresting arcuate movement of said seating portion on said base portion, said control means including:

1. a longitudinally extending flexible belt element attached at spaced points to the same one of said portions, and
2. a clamping means fixedly attached to the other of said portions, said clamping means including a base and a clamping member and receiving said flexible element in selectively releasable relation between them permitting rearward movement of said seating portion but arresting movement of said seat portion in a forward direction until said clamping member is released.

3. A chair comprising:

(a) a lower base portion including opposed sides, (b) an upper seating portion including opposed sides, said seating portion being mounted to said base portion for longitudinal arcuate movement of said seating portion relative to said base portion, (c) a retractible footrest assembly including:

1. a mounting frame carried between said seating portion sides, said frame including longitudinally extending side members operatively attached to associate sides and front and rear transverse members, p1 2. an arcuate guide tube attached to each of said side members,
3. a movable footrest including opposed arcuate side arms received in associated arcuate guide tubes and a transverse footrest member extending between said side arms and including a pivotable footrest pad,
4. drive means for moving said arms in fore and aft relation in said guide tubes, said drive means including front and rear longitudinally spaced transverse shafts mounted in journal relation between said frame side members, each of said shafts carrying a pair of transversely spaced rotatable sprocket elements, associated rotatable sprocket elements having a connected endless conveyor chain element extending therebetween, each conveyor chain element having adaptor means, and an elongate traveller shaft means attached to associated adaptor means for direct movement with said chain element and connected to said elongate arms, and operating means for rotating said shafts and said operatively connected footrest arms in a fore and aft direction, and
5. said arcuate side arms extending outwardly of said arcuate guide tubes along the same generally arcuate line.

4. A chair as defined in claim 3, in which:

(d) said operating means includes a rear shaft portion extending outwardly of one of said seating portion sides and having a manually operated crank portion at the end thereof.

5. A chair as defined in claim 3, in which:

(d) the traveller means is a transverse shaft connected to and extending beyond said adaptor means and having end portions connected to associated arms.

6. A chair as defined in claim 3, in which:

(d) each guide tube includes an elongate slot receiving a portion of the traveller means to facilitate connection to an associated arm.

7. A chair as defined in claim 3, in which:

(d) at least one of said seating portion sides and said longitudinal mounting frame side members are spaced from each other, and (e) the operating means includes an electric motor mounted between said spaced members.

8. A chair as defined in claim 7, in which:

(f) the operating means includes a rotatable element carried by the rear shaft of the drive means and connected to the electric motor in drive relation.

9. A chair comprising:

(a) a lower base portion including opposed sides, (b) an upper seating portion including opposed sides, said seating portion being mounted to said base portion for longitudinal arcuate movement of said seating portion relative to said base portion, (c) a retractible footrest assembly including:

1. guide means operatively carried by said seating portion sides,
2. a movable footrest including arm means received by said guide means and a transverse footrest member mounted between said arms, and
3. drive means for moving said arm means in fore and aft relation in said guide means, and (d) control means disposed between said seating portion and said base portion for selectively arresting arcuate movement of said seating portion on said base portion, said control means including:

1. a longitudinally extending flexible belt element of fabric material attached at spaced points to the same one of said portions, and
2. a clamping means fixedly attached to the other of said portions said clamping means including a base and a clamping member, in the form of a pivoted lever rotatably mounted to said base, said base and said pivoted lever receiving said flexible belt element in selectively releasable relation between them in wedging relation permitting rearward movement of said rest portion but arresting movement of said seat portion in a forward direction until said clamping member is released.

10. A chair as defined in claim 9, in which:

(e) said seating portion includes spaced transverse members and said longitudinal extending flexible element extending between and operatively connected to said transverse members, (f) said base portion includes a transverse member disposed between said seating portion transverse members and carrying said clamping member.

11. A chair as defined in claim 10, in which:

(g) said control means includes a transverse shaft having a lug thereon selectively engageable with said pivoted lever to move said lever to a position permitting substantially free fore and aft movement of said belt relative to said base.

12. A chair as defined in claim 11, in which:

(h) said transverse shaft includes a shaft portion extending outwardly of one of said seating portion sides and having a manually operated crank at the end thereof.

* * * * *